US007322286B2

(12) United States Patent
Labeille et al.

(10) Patent No.: US 7,322,286 B2
(45) Date of Patent: Jan. 29, 2008

(54) DEVICE FOR COMPACTING WASTE IN A CONTAINER, ESPECIALLY A HOUSEHOLD BIN

(75) Inventors: Frédéric Labeille, Paris (FR); Mathias Destais, Cairon (FR)

(73) Assignee: Sita France, Nanterre (FR)

( * ) Notice: Subject to any disclaimer, the term of this patent is extended or adjusted under 35 U.S.C. 154(b) by 0 days.

(21) Appl. No.: 10/558,025

(22) PCT Filed: Apr. 26, 2004

(86) PCT No.: PCT/FR2004/001008

§ 371 (c)(1),
(2), (4) Date: Aug. 2, 2006

(87) PCT Pub. No.: WO2004/108565

PCT Pub. Date: Dec. 16, 2004

(65) Prior Publication Data

US 2007/0034098 A1 Feb. 15, 2007

(30) Foreign Application Priority Data

May 28, 2003 (FR) ..... 03 06525

(51) Int. Cl.
*B30B 5/02* (2006.01)
*B65D 6/00* (2006.01)

(52) U.S. Cl. ..... 100/211; 100/90; 100/220; 100/247; 100/269.02; 220/666; 220/669; 220/677

(58) Field of Classification Search ..... 100/90, 100/116, 211, 215, 247, 200, 229 A, 269.02, 100/269.03, 269.04; 220/4.01, 666, 669, 220/677

See application file for complete search history.

(56) References Cited

U.S. PATENT DOCUMENTS

| | | | | |
|---|---|---|---|---|
| 1,372,190 | A * | 3/1921 | Randall et al. | 100/90 |
| 3,269,157 | A * | 8/1966 | Jordan | 68/242 |
| 5,355,789 | A * | 10/1994 | Suzuki et al. | 100/92 |
| 2003/0136279 | A1* | 7/2003 | Tarlow | 100/90 |

FOREIGN PATENT DOCUMENTS

| | | |
|---|---|---|
| DE | 41 20 743 A | 1/1993 |
| EP | 0 209 639 A | 1/1987 |
| WO | WO-87 04686 A | 8/1987 |

* cited by examiner

*Primary Examiner*—Jimmy T. Nguyen
(74) *Attorney, Agent, or Firm*—Connolly Bove Lodge & Hutz LLP

(57) ABSTRACT

The invention relates to a bin for storing a volume of waste that can be reduced by compaction. The bin includes an apparatus for reducing the pressure exerted in the volume of the bin, under the effect of a vacuum, and ensures that the waste is compacted. The bin includes a tight deformable enclosure in which the waste is collected, optionally contained in a disposable bag, and the tight deformable enclosure includes at least one lateral wall consisting of an assembly of rigid plates or segments (2) which are articulated in relation to each other in such a way as to form a deformable apron that subjects the waste to a compression force between the lateral deformable apron wall and the opposite wall, under the effect of the vacuum being exerted in the enclosure, one of the sides of said enclosure being open for introducing waste, and provided with a tight cover (6).

28 Claims, 9 Drawing Sheets

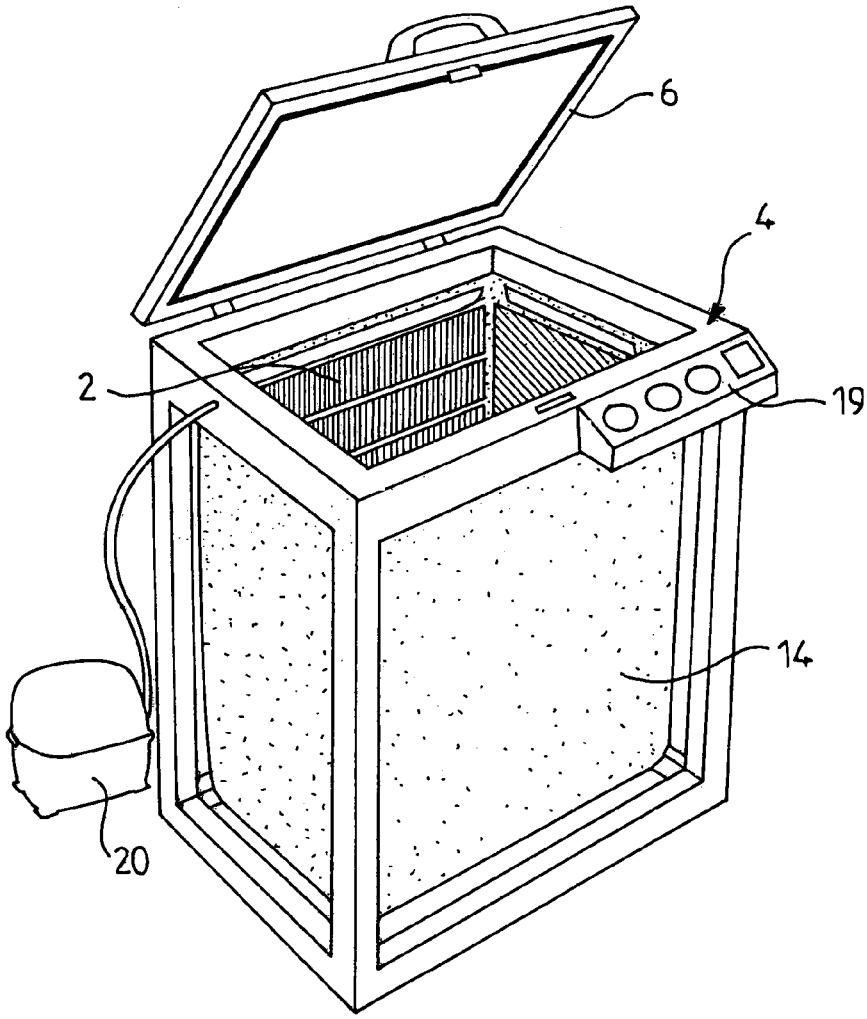
FIG.18
FIG.19a
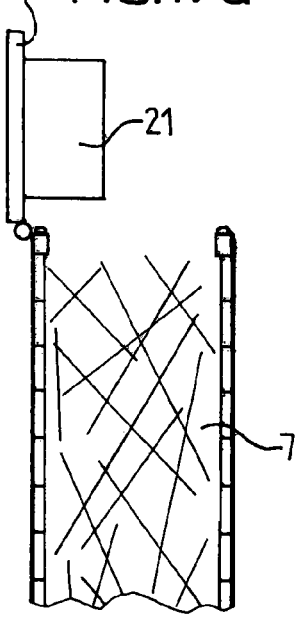
FIG.19b
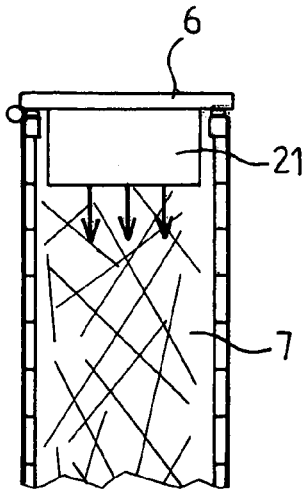
FIG.19c
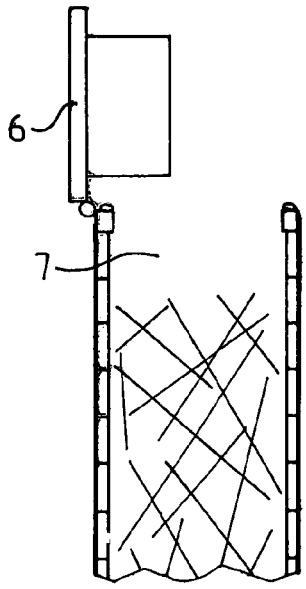

FIG.20a
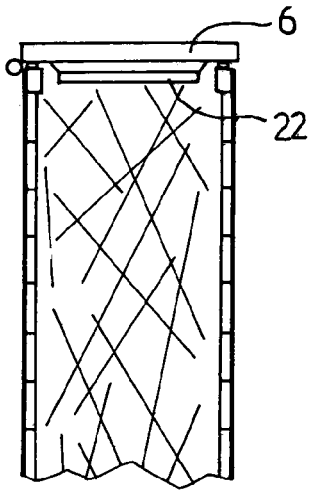
FIG.20b
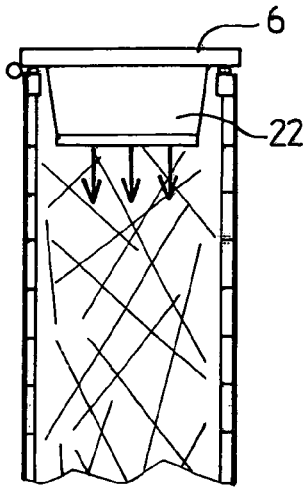
FIG.20c
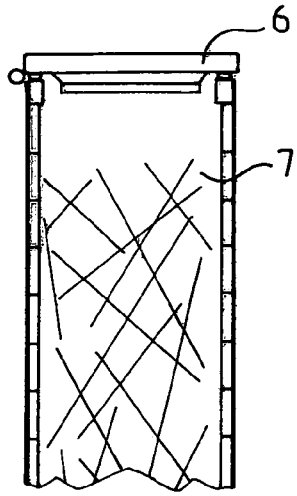
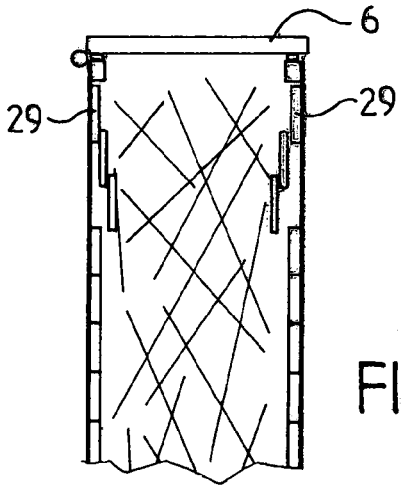
FIG.21a
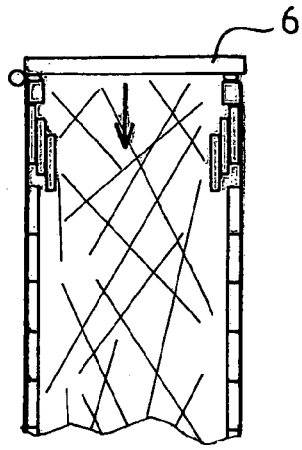
FIG.21b
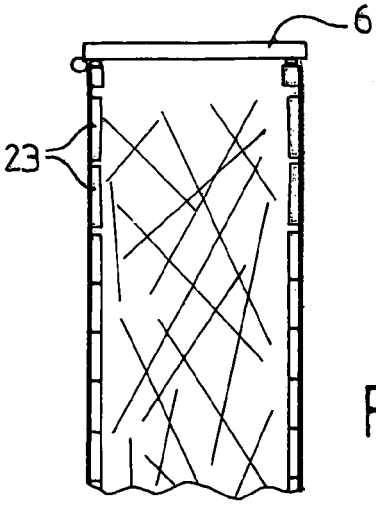
FIG.22a
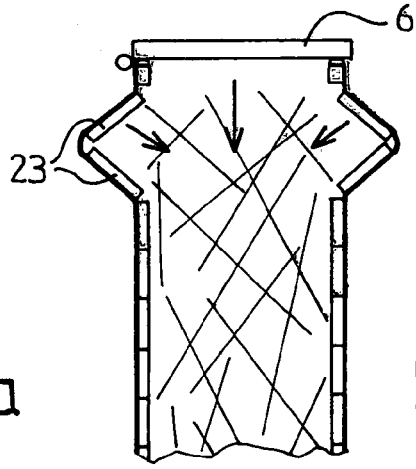
FIG.22b FIG.23a
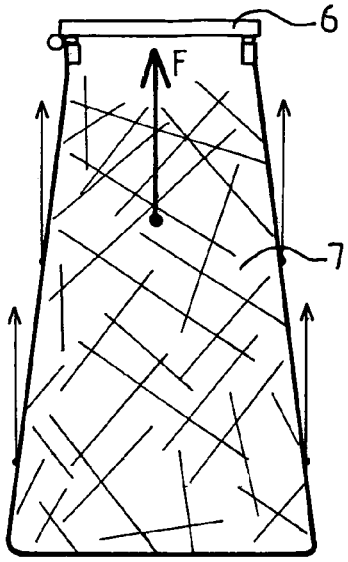
FIG.23b
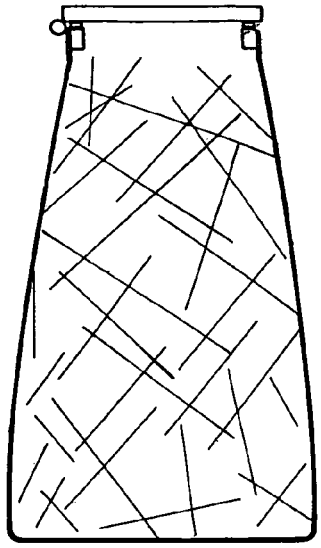
FIG.23c
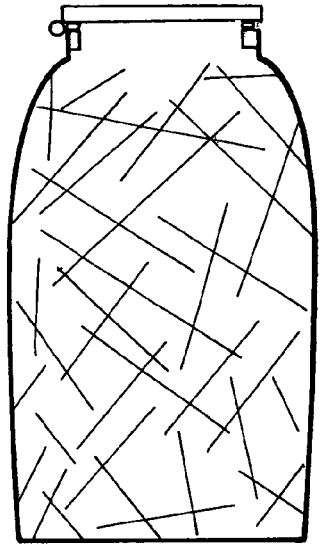
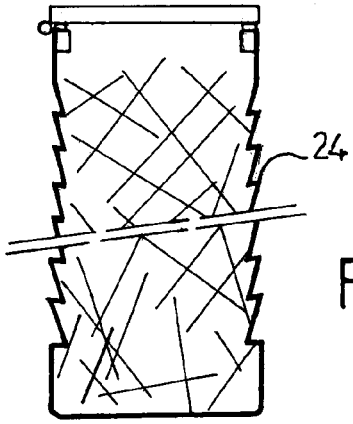
FIG.24
FIG.25a
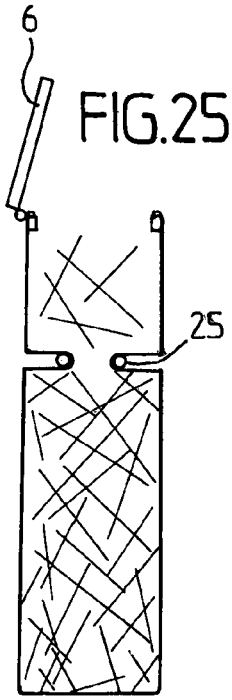
FIG.25b
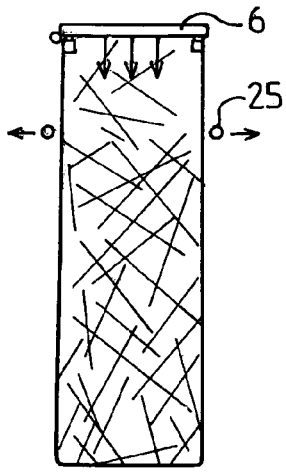
FIG.25c
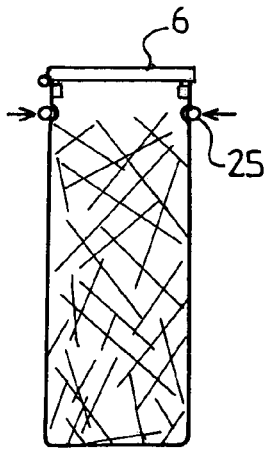
FIG.25d
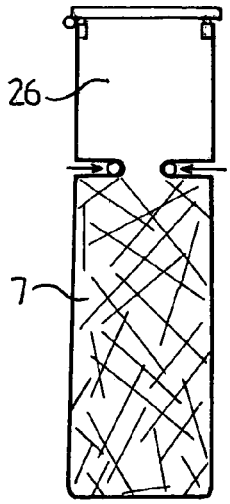

DEVICE FOR COMPACTING WASTE IN A CONTAINER, ESPECIALLY A HOUSEHOLD BIN

BACKGROUND OF THE INVENTION

The present invention relates to a device for squashing down waste such as household, industrial, hospital and other waste. It is essentially designed for compacting waste at its place of production, such as in the consumer's home.

To facilitate the handling of household refuse and waste, from the consumer's home to the waste sorting and processing center, compacting devices have been put forward: these enable a considerable amount of space to be saved, particularly when it comes to dry waste such as recyclable containers (plastic bottles, boxes, food cans, etc.). Compacting also facilitates waste collection simply because the waste takes up less space and therefore needs less frequent pick-ups. This in turn saves money for the community as a whole (fewer waste-collecting containers to be handled, faster turn-around of dumpsters, reduction of noise pollution, etc.). Compacting is also of great benefit to the user since it means that his garbage cans take up less space and they do not need taking out so often.

To this end, there are devices which use pressure to compress the waste: they generally use a piston or a moving plate to reduce the volume inside a container in which the waste is put. This prior art is illustrated particularly by:

FR-A-2 184 941, which discloses a household refuse compressing system which comprises a container containing the waste to be compacted, in which a pressure plate can move vertically, under the action of pressure, to press against the waste. This is a relatively complicated device having the major drawback of requiring a heavy and voluminous lid to contain the pressure plate actuating means.

The prior art also includes devices which use vacuum systems to compact, in the home, by negative pressure, waste contained in the receptacles. This technique is capable of compressing most recyclable packaging materials, the vacuum storage of waste also being favorable from the point of view of odors since it greatly limits bacterial growth and the ageing of leftover food. Vacuum compression also causes packaging materials to collapse tightly together, optimizing the volume without causing any difficulty for the sorters at the sorting center because as soon as the vacuum is relaxed the packaging materials fall apart naturally.

For the prior art of this technique, particular mention may be made of:

U.S. Pat. No. 3,899,967, which relates to a refuse compacter of the flexible bellows type. When negative pressure is applied inside the compacter, the bellows close up accordion-fashion and compact the refuse. The problem with this kind of solution is that only a small waste compression ratio can be achieved with such a compacter. The reason for this is that as the waste is being compacted it gets in between the bellows and thus impedes compression. Furthermore, a lot of the energy that could be obtained from the negative pressure is wasted in raising the bellows, the base and the waste itself. Another disadvantage is that if food cans are trapped between the bellows, the bellows may be damaged, putting the compacter out of service.

EP-A-0 989 059, which consists in fitting, to the upper opening of a disposable bag in which the waste is placed, a suction hood connected to a vacuum system. This is a mechanically simple device but does require a certain amount of handling by the user in the home (fitting and removing the suction hood) and has the further disadvantage of making direct use of disposable bags which by definition are flimsy and are likely to split when exposed directly to a vacuum, which may result in the bag being torn due to the presence of hard parts on the waste to be compacted (such as food cans, the corners of cardboard boxes etc.). In any case, the efficiency of this prior-art device is very poor.

Taking this prior art as its starting point, it is an object of the present invention to provide a device that will compact household waste in the home by compressing it using the action of negative pressure, this device being simple and uncomplicated in both design and use and easy to maintain, and not having the drawbacks of the approaches of the prior art and yet also being very much more efficient.

SUMMARY OF THE INVENTION

Consequently this invention relates to a garbage can for storing household waste in particular, capable of having its volume reduced by compaction, comprising means which, under the effect of a partial vacuum, reduce the pressure within the volume of the garbage can and compact the waste, this garbage can being characterized in that said means are produced in the form of an airtight deformable enclosure in which the waste, optionally in a disposable bag, is collected, and in that said deformable enclosure comprises at least one side wall composed of an assembly of rigid plates or boards hinged together in such a way as to form a deformable apron which, under the effect of the partial vacuum acting inside the enclosure, subjects the waste to a compressive effort between said deformable-apron side wall and the wall opposite it, one of the faces of said enclosure being open for the introduction of the waste and being provided with an airtight lid.

In one preferred embodiment, said deformable enclosure comprises two side walls opposite each other and forming deformable aprons.

In a first embodiment of the invention, the deformable enclosure consists of a strong plastic airtight flexible bag or envelope bag which is positioned in a supporting structure or cladding and which accommodates a deformable container in which the waste, optionally in a disposable bag, is collected, said container comprising at least one side wall that forms said deformable apron.

In another embodiment of the invention, the deformable enclosure consists of an airtight flexible bag or envelope bag made by assembling, for example by adhesive bonding or welding, a number of coated fabric surfaces in the general shape of a right-angled parallelepiped, one of whose small faces is open to allow the waste to be put in, while the other small face forming the bottom is rigid. Said envelope bag is attached in an airtight manner to a rigid frame acting as a plane of closure for a door that is used to close the opening of the envelope bag. At least one of the large walls of the envelope bag is made in such a way as to form said deformable apron by being fitted with said hinged plates or boards. In this illustrative embodiment, the rigid boards or plates may be positioned in contiguous pockets provided on the inside face of said wall forming the deformable apron, these pockets being closed by adhesive bonding after said plates or boards have been placed in them. In a variant, these hinged plates or boards may be bonded directly to the bag or produced as a composite structure, particularly a flexible material overmolded onto a rigid material, or by a particular geometry of the envelope bag in the form of a pronounced thickening or a network of ribs.

BRIEF DESCRIPTION OF THE DRAWINGS

Other features and advantages of the present invention will be disclosed by the description given below with reference to the attached drawings, which show various illustrative, entirely non-limiting embodiments thereof. In the drawings:

FIG. 18 is a perspective general view of the subject of the present invention, with its cladding, its control panel and the vacuum pump;

FIGS. 19*a*-19*c* show a first illustrative embodiment of the means of squashing the waste into the bottom of the envelope bag, these figures being views similar to FIGS. 1 and 2;

FIGS. 20*a*-20*c* are views similar to FIGS. 19*a*-19*c* illustrating a second illustrative embodiment of the means of squashing the waste into the bottom of the envelope bag;

FIGS. 21*a* and 21*b* are views similar to FIGS. 19*a*-19*c* showing a third illustrative embodiment of the means of squashing the waste into the bottom of the envelope bag;

FIGS. 22*a* and 22*b* are views similar to FIGS. 19*a*-19*c* showing a fourth illustrative embodiment of the means of squashing the waste into the bottom of the envelope bag;

FIGS. 23*a*-23*c* are views similar to FIGS. 19*a*-19*c* showing a first illustrative embodiment of the means of preventing the waste expanding upward again inside the envelope bag;

FIG. 24 is a view similar to FIGS. 19*a*-19*c* showing a second illustrative embodiment of the means of preventing the waste expanding upward again inside the envelope bag;

FIGS. 25*a*-25*d* are views similar to FIGS. 19*a*-19*c* showing a first illustrative embodiment of the means provided by the invention for keeping the waste in the envelope bag and creating an unoccupied entrance space;

DETAILED DESCRIPTION OF THE INVENTION

Figure 1:
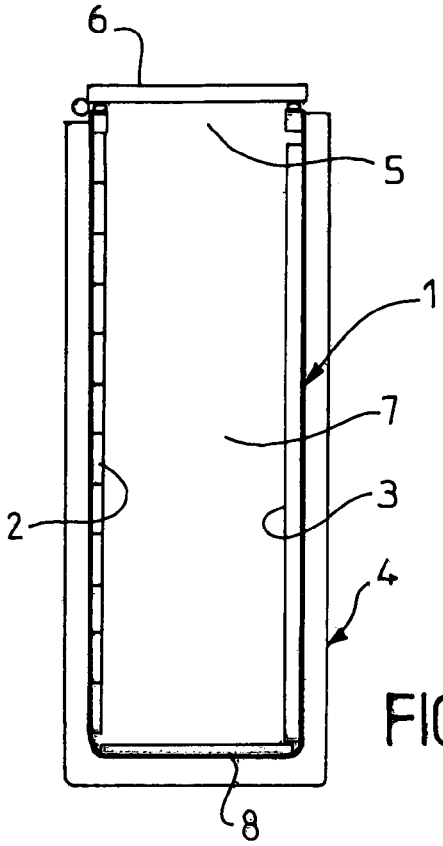
FIGS. 1 and 2 are schematic views in cross section taken on a vertical plane through a first illustrative embodiment of the device according to the present invention.
Figure 2:
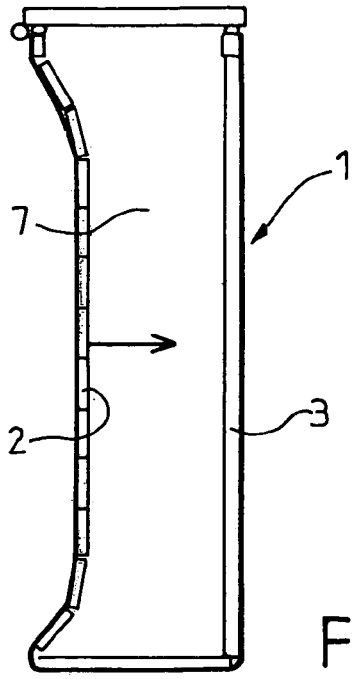

Referring initially to FIGS. 1 and 2, these show a first illustrative embodiment of the device of the invention. As stated above, this device comprises means which, under the effect of a partial vacuum, reduce the pressure within the volume of a garbage can in order to compact the waste. In the present invention these means are produced in the form of an airtight deformable enclosure denoted by the reference 1, in which the waste, optionally in a disposable bag (not shown) is collected, this enclosure 1 comprising at least one side wall consisting of an assembly of rigid plates or boards 2 hinged together in such a way as to form a deformable apron which, under the effect of the partial vacuum acting inside the enclosure, subjects the waste to a compressive load between this side wall with its rigid plates or boards 2 and the opposite wall 3. As FIG. 1 shows, the airtight deformable enclosure 1 is positioned in a supporting structure or cladding 4 and one of its faces 5 is opened to allow the waste to be inserted, this open face being fitted with an airtight lid 6.

FIG. 1 shows the device of the invention at rest, that is without a partial vacuum, and FIG. 2 shows the device in use, with a partial vacuum applied inside the enclosure 7, this having the effect of causing the deformable apron composed of the assembled rigid plates or boards such as 2 to move toward the wall 3 of the device. As will be realized, this movement of the deformable apron will compress the waste contained inside the enclosure 7.

Figure 3:
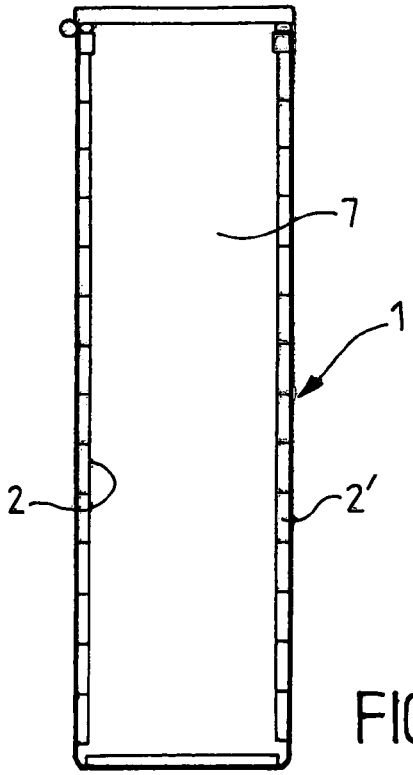
FIGS. 3 and 4 are schematic views similar to FIGS. 1 and 2 showing another illustrative embodiment.
Figure 4:
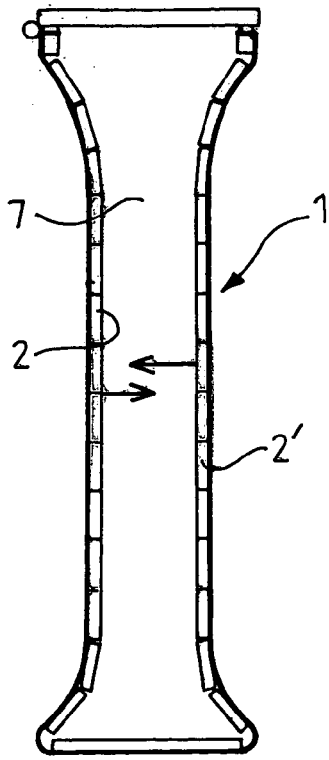

In the alternative embodiment illustrated in FIGS. 3 and 4, the airtight deformable enclosure 1 of the device according to the invention comprises two side walls constructed in such a way as to form two deformable aprons, and for this purpose these walls are each fitted with assemblies of rigid plates or boards 2, 2' which, when the negative pressure (FIG. 4) is applied, move toward each other as shown by the arrows, thus compressing the waste contained inside the enclosure 7.

In a first illustrative embodiment of the invention, the deformable enclosure 1 may take the form of a strong plastic airtight flexible bag or envelope bag placed as illustrated in FIG. 1 in the supporting structure or cladding 4. This flexible envelope bag accommodates a container that comprises at least one side wall forming the deformable apron, for which purpose it is fitted with rigid boards or plates such as 2.

In another illustrative embodiment of the invention which will be described below with reference to FIGS. 11-14, the side wall or walls of the deformable apron are actually integrated into the envelope bag.

Figure 7:
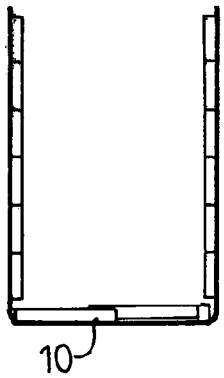
FIGS. 7 and 8 are partial views similar to the previous views, showing an illustrative embodiment of the bottom of the device.
Figure 8:
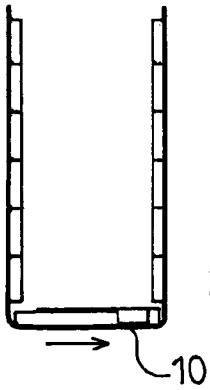

The bottom wall 8 of the device of the invention is rigid and may consist of a single panel as illustrated in FIG. 1 in particular. Alternatively it may be produced in the form of two plates 9, 9' hinged to each other as illustrated in FIGS. 5 and 6, or in the form of a telescopic bottom 10 as shown in FIGS. 7 and 8, or may be made of a thick flexible elastomeric material.

Figure 5:
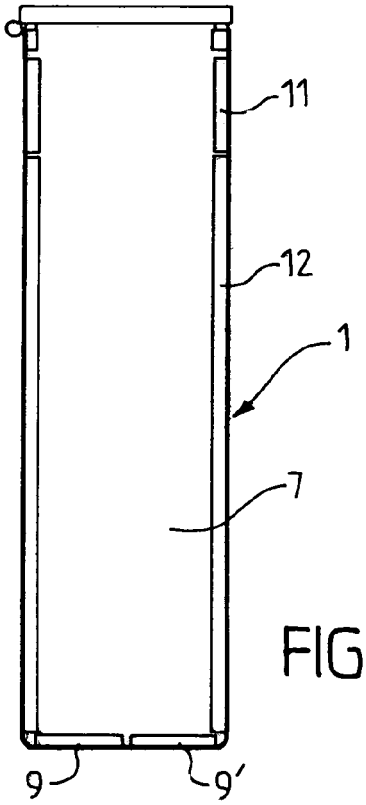
FIGS. 5 and 6 show variants of the illustrative embodiment shown in FIGS. 3 and 4.
Figure 6:
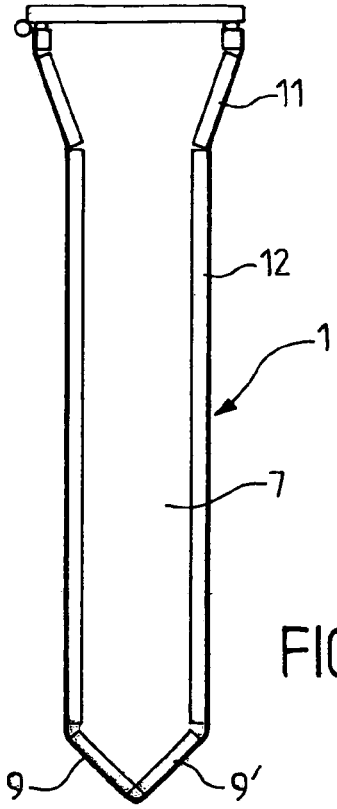

In the illustrative embodiment shown in FIGS. 5 and 6, the deformable apron formed by the side walls of the device is made in the form of an upper plate 11 hinged to a lower panel 12, operating being in other respects identical to the embodiments described earlier. FIG. 6 shows clearly how the waste contained in the enclosure 7 is compacted when a partial vacuum is created inside it.

Figure 9:
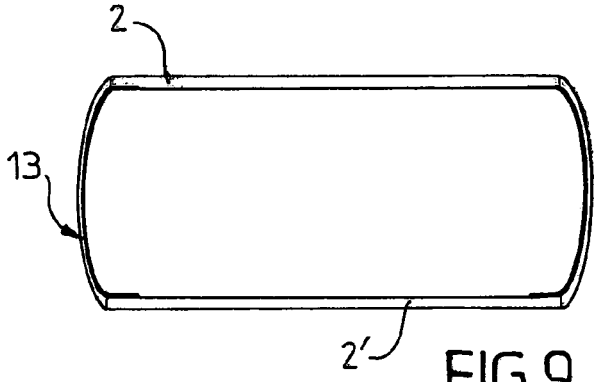
FIGS. 9 and 10 are plan views of the device of the invention showing an embodiment of the edge walls of the flexible airtight envelope bag.
Figure 10:
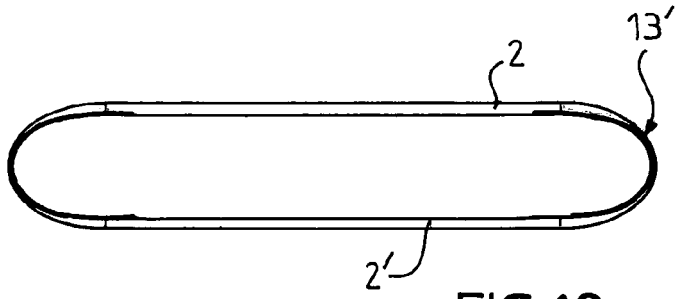

Referring now to FIGS. 9 and 10, these show plan views of the device of the invention. The figures show schematically the side walls of the device that form the deformable aprons by virtue of the presence of the hinged boards such as 2, 2' and the edge walls 13, 13' forming the small side walls of the container. These edge walls are designed to fold up on themselves in outward movement when the partial vacuum is applied (FIG. 10). They are produced in a flexible and elastic material such as an elastomer. Their thickness, profile and rigidity are designed to ensure that they are not attracted by the partial vacuum before the side walls of the device forming the deformable aprons have been able to advance toward each other, so that said edge walls do not interfere in the compression of the objects and do not create undesirable folds. It may be produced by adding an elastomeric sheet or by thickening the material of the bag itself. Also, and for the same purpose, an outward preform will preferably be formed for the connection between the edge walls and the side walls of the device.

Figure 13:
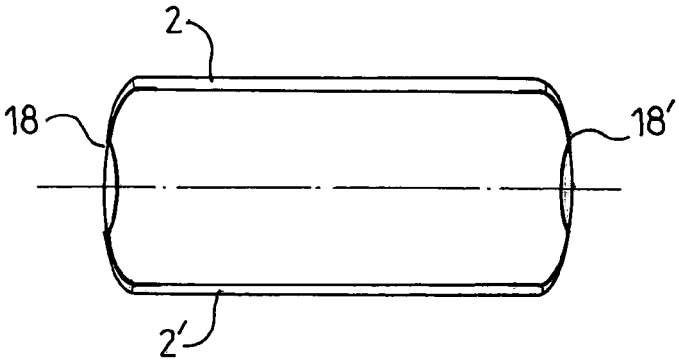
FIGS. 13 and 14 are views similar to FIGS. 9 and 10 but showing an embodiment of the edge walls of the illustrative embodiment shown in FIGS. 11 and 12.
Figure 14:
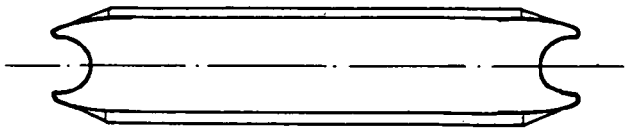
Figure 12A:
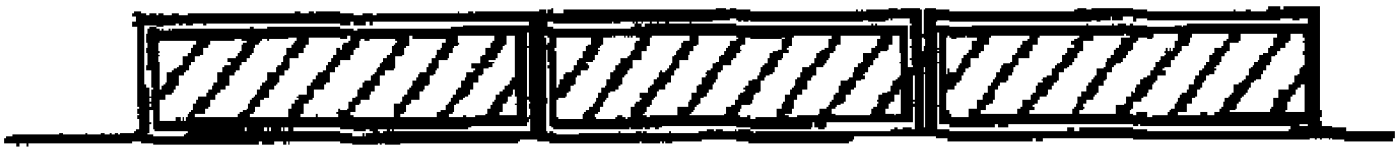
FIG. 12*a* is a view of contiguous pockets provided on the inside face of the wall

FIGS. 13 and 14 show the construction of the small sides of the envelope bag. These small sides 18, 18' are made of a flexible elastic material in order to provide a deformable part all the way up the height of the bag in order to prevent the bag material inserting itself between the two deformable aprons represented by the assembled hinged plates 2, 2'. These small sides are specially preformed (see FIG. 13) to guide their folding when the partial vacuum is applied (FIG. 14). They can be made in the form of elastomeric plates positioned in vertical pockets provided in the envelope bag, or by selecting a thicker coated fabric for these areas of the envelope bag 14.

We now turn to the second illustrative embodiment of the invention, in which the deformable apron or aprons represented by the assembly of mutually hinged rigid plates or boards are integrated into the airtight envelope bag of the device.

Figure 11:
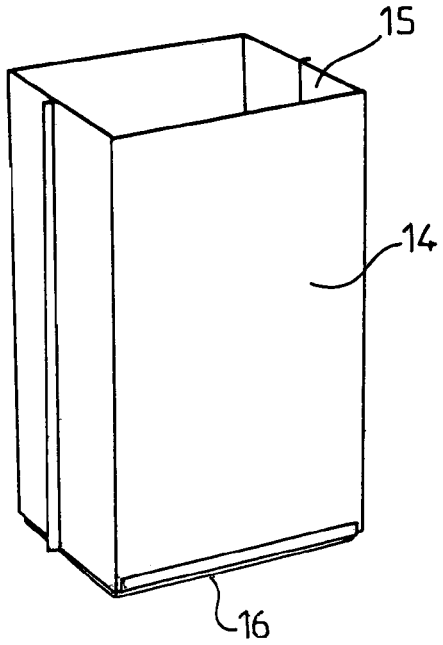
FIG. 11 is a schematic perspective view showing another preferred illustrative embodiment of the subject of the invention.

Shown in perspective in FIG. 11 is an illustrative embodiment of such an envelope bag which is given the general reference 14. It may be defined as a composite structure that satisfies technical constraints whose characteristics are specific: airtightness, general flexibility, and rigid parts connected to each other by rigid parts and elastic parts. In this illustrative embodiment the envelope bag 14 is made by assembling, for example by adhesive bonding or welding, a number of coated fabric surfaces in the general shape of a rectangular parallelepiped, one of the small sides 15 of which is open to allow the waste to be put in, while the other small side 16 opposite it is rigid. The open small side 15 of this envelope bag is assembled in an airtight manner to a rigid frame similar to that of the cladding 4 described above with reference to FIG. 1. This rigid frame also acts as a plane of closure for the door when placed over the opening of the envelope bag to seal it.

Figure 12:
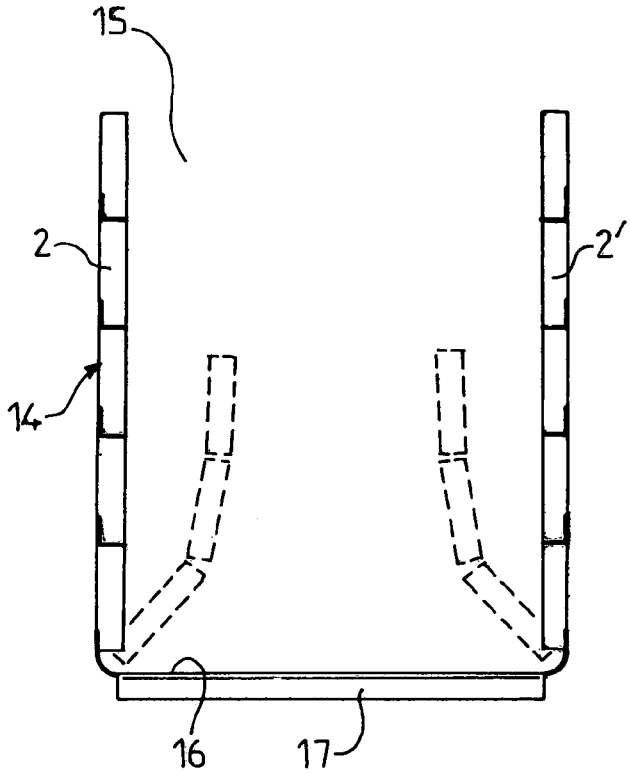
FIG. 12 is a schematic view similar to FIG. 1 showing on an enlarged scale the illustrative embodiment shown in FIG. 11.

As shown in detail in FIG. 12, the two large vertical sides of the envelope bag 14 are each constructed in such a way as to form a deformable apron as described above. For this purpose the bag is provided with the hinged boards or plates such as 2 and 2'. These plates or boards can be positioned in a series of contiguous pockets provided on each of the inside faces of the wall that is to form the deformable apron. The pockets are then closed, e.g. by adhesive bonding. Alternatively the hinged plates or boards 2, 2' may be bonded directly to the inside face of said walls. In the same way the bottom 16 can be made in the form of a rigid plate 17 placed in a pocket provided on the bottom of the bag 14, on either the inside or outside of the bottom.

Figure 15:
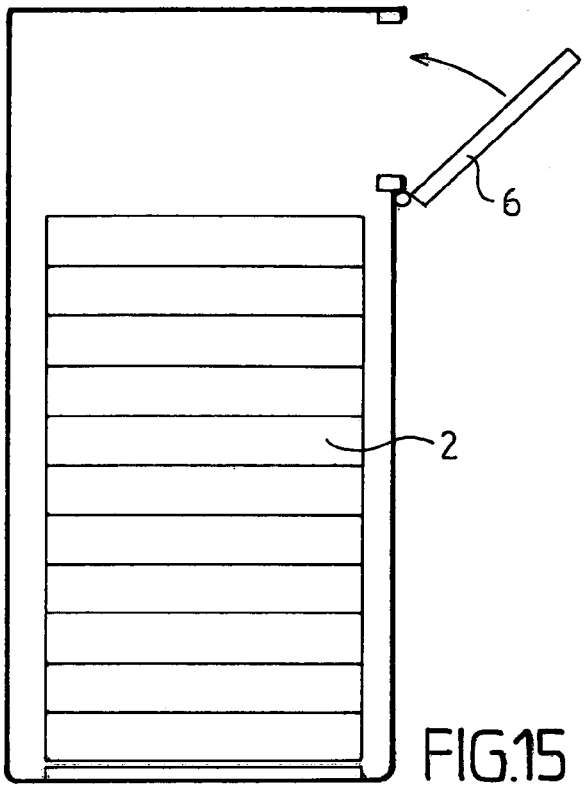
FIGS. 15 and 16 are side and front views, respectively, of the device of the invention in vertical section and elevation showing two illustrative embodiments of the access to the flexible envelope bag.
Figure 16:
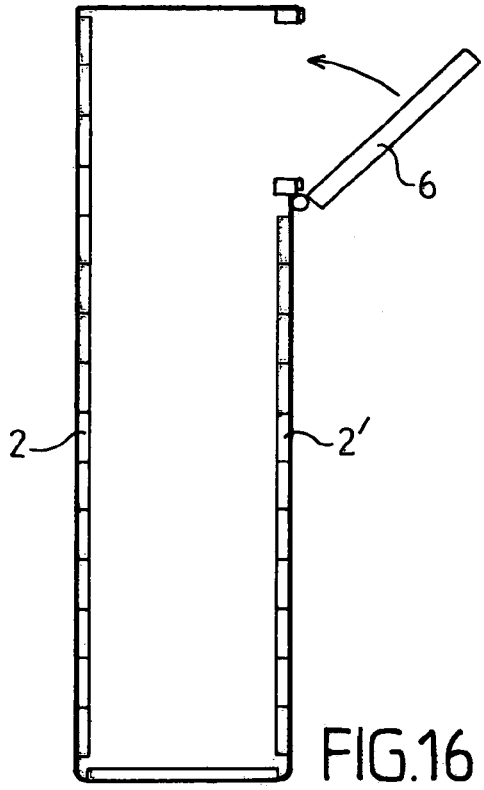

The opening designed for introducing the waste that is to be compressed (the latter optionally being in a disposable bag), can be located at the top of the device and in particular at the top of the airtight envelope bag 1 or 14. Alternatively it may be located on one of the lateral sides as illustrated in FIGS. 15 and 16. In FIG. 15, the opening with its lid 6 is provided on the small vertical side of the device so that the device can be fitted underneath a work surface in order to optimize the usable depth, the garbage can then occupying the full available depth underneath the work surface. In the alternative illustrated in FIG. 16, the opening is located on the large vertical side of the device.

Figure 17A:
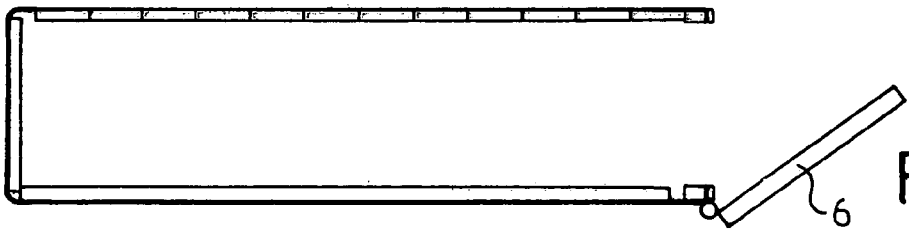
FIGS. 17*a*-17*c* show a horizontal version of the device of the invention.
Figure 17B:
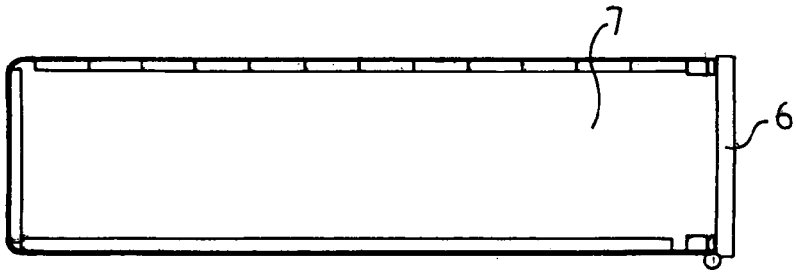
Figure 17C:
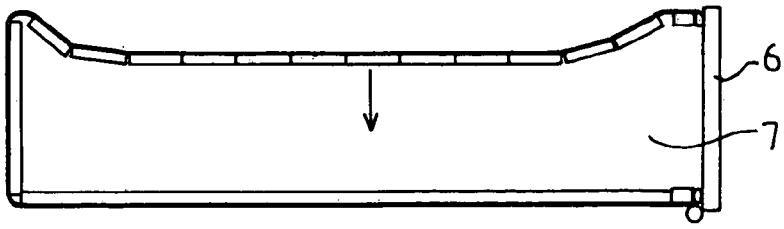

Another possible alternative is for the device to be positioned horizontally. This alternative is illustrated in FIGS. 17*a*-17*c*. It is particularly intended to be integrated into a fitted kitchen or for an arrangement comprising several specialized containers (sorting, food, paper, etc.). The waste can be put in the can either via a sliding drawer or through a door 6 as in the example illustrated in FIGS. 17*a*-17*c*, in which FIG. 17*a* shows the container before the waste is put in, FIG. 17*b* the same container with the door 6 closed before application of the partial vacuum in its enclosure 7, and FIG. 17*c* the same container during application of a partial vacuum inside the enclosure 7, operation being exactly as illustrated in FIG. 2, described earlier.

FIG. 18 shows a general view of the device of the invention. As can be seen, the container consists of the envelope bag 14 incorporating the deformable apron or aprons consisting of the assembled hinged plates such as 2, 2', this assembly being placed in the cladding 4 which is provided with the airtight lid 6 and with a control panel 19. In this illustrative embodiment the vacuum pump 20 is located outside of the cladding 4.

In the device according to the present invention, the enclosure 7 into which the waste is put soon becomes filled by the waste because the waste springs back partly into its original shape (the memory effect) after the vacuum is broken and does not fall to the bottom of the container. The enclosure 7 may therefore quickly run out of available volume for the introduction of more waste. To avoid this problem, the invention provides means of squashing the waste vertically down in order to free up empty space at the top of the bag so that more waste can easily be added. These means may consist in, say, squashing the waste vertically down and/or limiting its re-expansion within the enclosure 7 and/or creating an unoccupied entrance space at the top of the enclosure.

Referring initially to FIGS. 19*a*-19*c*, these show an illustrative embodiment of the means provided by the invention for squashing the waste vertically down into the bottom of the envelope bag 3 or 14 during the course of the enclosure 7 filling cycle. For this purpose the lid 6 includes a volume-forming part 21 which pushes the waste mechanically down when closed. FIG. 19*b* clearly shows the "ram" effect produced on the waste by the presence of the volume 21 of the lid 6, while FIG. 19*c* shows the volume left unoccupied at the top of the enclosure 7 by the volume 21.

The same effect can be obtained by the variant illustrated in FIGS. 20*a*-20*c* in which the lid 6 is provided with a retractable volume 22 that can be caused to protrude into the enclosure 7. This retractable volume can be made by having a device underneath the lid which is operated when the enclosure 7 is evacuated. This bellows or piston device descends under the effect of the evacuation of the enclosure 7. It is held up (in the lid 6) by a weak force which may for example be restoring springs for raising it when the vacuum is broken. The force of the device can be increased by applying pressure to it, and it will then help to squash the waste down into the bottom of the envelope bag. FIG. 20*b* shows how this device works to provide an unoccupied volume at the top of the enclosure 7.

Another solution to this problem is to provide telescopic boards such as 29 at the top of the envelope bag, above the deformable aprons. This solution is illustrated in FIGS. 21*a* and 21*b*. As will be understood (see FIG. 21*b*), this solution allows the lid 6 to be lowered, so squeezing the waste contained in the envelope bag.

Another solution is to provide boards 23 hinged in a parallelogram at the top of the envelope bag, below the lid 6. This solution is illustrated in FIGS. 22*a* and 22*b*. Like the previous solution, it enables the lid 6 to be lowered in order to push the waste down.

The waste can also be squashed vertically down by applying a vibrating movement to the envelope bag. This movement helps to move the waste down under gravity and therefore helps to squash it. This vibrating movement may be transmitted to the envelope bag by, for example, the natural vibration of the vacuum pump.

This vertical squashing down of the waste can also be brought about by providing a flexible and compressible part at the top of the envelope bag.

In order further to improve the action of the device of the invention, it may be fitted with means for limiting the degree to which the waste expands upward again after the vacuum is broken. These means are illustrated in FIGS. 23*a*-23*c*. They consist in making the envelope bag in the shape of, for example, a wedge (FIG. 23*a*), a pointed arch (FIG. 23*b*) or a bottle (FIG. 23*c*). Thus, when the waste re-expands after the vacuum is broken, the vertical component of expansion of the volume (arrow F) is constrained by the outer surface of the bag. The waste therefore tends to be confined to the bottom of the volume 7.

In another illustrative embodiment, the waste can be prevented from expanding upward by providing asperities on the inside surface of the envelope bag. This alternative is illustrated in FIG. 24, where the asperities are indicated diagrammatically at 24. The asperities may be represented by the shape of the rigid boards such as 2, 2' of the hinged apron or aprons, but they may also be provided by details in the molding of the envelope bag.

In another illustrative embodiment there is a neck at the top of the deformable bag to keep the waste in the lower part of the envelope bag and create an unoccupied entrance space. This illustrative embodiment consists in first generating a piston action to push the waste down, and secondly generating a non-return action to resist the re-expansion of the compressed waste toward the top of the envelope bag.

In the embodiment shown in FIGS. 25*a*-25*d*, the top of the envelope bag comprises a moving neck, that is to say the neck is designed to apply pressure, when the vacuum is broken, to the top of the compressed waste contained in the enclosure 7 of the envelope bag. The waste can thus be held down in the bottom of the volume 7, allowing access to an unoccupied volume so that more waste can be put in.

In the example illustrated in FIGS. 25*a*-25*d*, this moving neck is made in the form of a shaped, e.g. toric, tube 25 extending around the upper part of the envelope bag and supplied with compressed air by a system operated by the opening of the door 6. FIG. 25*a* shows the position before compression as the waste is being introduced into the enclosure 7, FIG. 25*b* the situation during compression, the lid 6 being moved downward, FIG. 25*c* the position after compression and before breakage of the vacuum, and FIG. 25*d* the situation after compression of the waste and before the can is opened, this figure clearly showing the presence of the unoccupied entrance space 26 left free at the top of the enclosure 7 of the envelope bag.

Figure 26A:
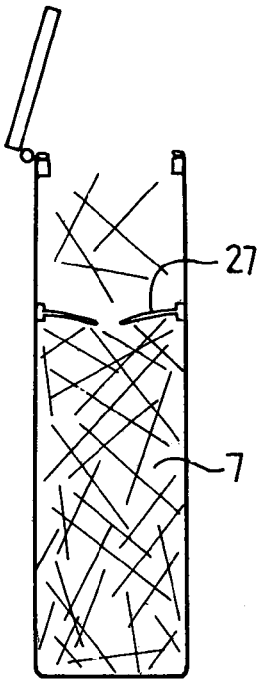
FIGS. 26*a*-26*d* are views similar to FIGS. 19*a*-19*c* showing a second illustrative embodiment of the means provided by the invention for keeping the waste in the envelope bag and creating an unoccupied entrance space.
Figure 27A:
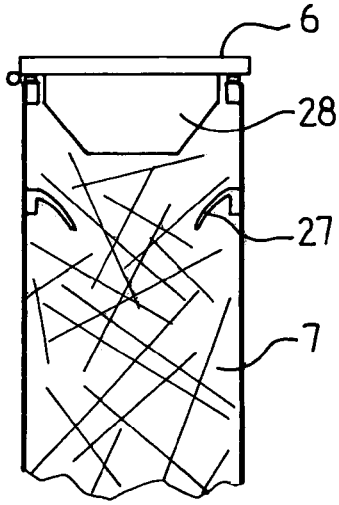
FIGS. 27*a* and 27*b* are views similar to FIGS. 19*a*-19*c* showing a third illustrative embodiment of the means provided by the invention for keeping the waste in the envelope bag and creating an unoccupied entrance space.
Figure 27B:
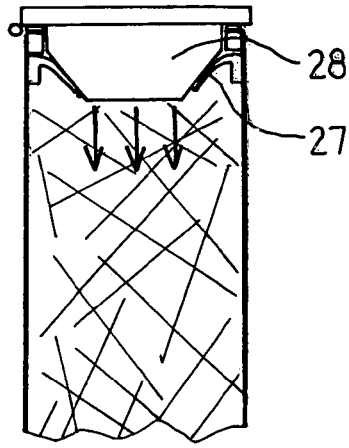

In the alternative illustrated in FIGS. 26*a*-26*a* and 27*a* and 27*b*, a fixed neck is used for the same purpose of keeping the waste inside the envelope bag while creating an unoccupied entrance space at the top of the bag.

In this solution, the fixed neck is made of a flexible material such as an elastomer in such a way that the waste can pass through it on its way down but not up. This fixed neck can be made in the form of a simple elastic belt around the perimeter of the envelope bag, so that force is required for material to pass through vertically, or by means of a system of horizontal flexible blades 27 mounted on the inside of the bag and exerting a non-return action.

Figure 26B:
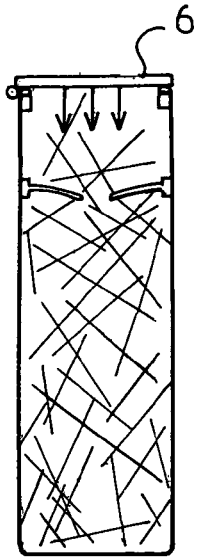
Figure 26C:
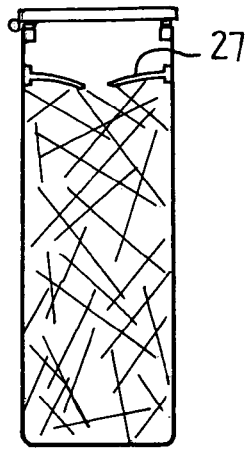
Figure 26D:
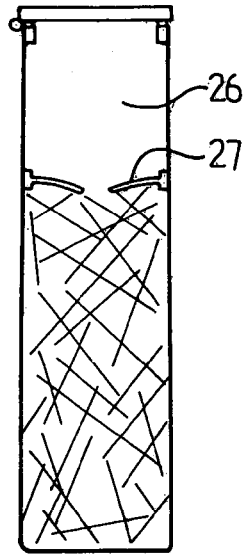

FIG. 26*a* shows the position before compression, as the waste is being introduced into the enclosure 7, FIG. 26*b* the situation during compression, the lid 6 being moved downward, FIG. 26*c* the position after compression and before breakage of the vacuum, and FIG. 26*d* the situation after compression of the waste and before the can is opened, this figure clearly showing the presence of the unoccupied entrance space 26 left free at the top of the enclosure 7 of the envelope bag.

In the other illustrative embodiment shown in FIGS. 27*a* and 27*b*, the internal shape 28 of the lid 6 has been given a configuration that helps to ensure that the waste passes all of the way through the fixed neck 27, operation in other respects being exactly the same as described above.

The general operating cycle of the garbage can according to the invention is as follows:

the waste is introduced,
the lid is closed,
a partial vacuum is applied (squashing the waste down),
the vacuum is broken,
the can is opened.

This sequence is repeated until the envelope bag is full. There are numerous possible applications of the invention. It can be used to compress not only dry waste (such as cardboard packaging, food cans, and plastic bottles) but also organic waste.

In this application, besides the advantage of the reduction in volume of the waste by compression, the invention keeps the waste in anaerobic conditions, thus preventing the growth of bacteria.

It will be understood of course that the present invention is not limited to the illustrative embodiments or applications described and/or mentioned above, and that it encompasses all variants thereof.

The invention claimed is:

1. A garbage can capable of having its volume reduced by compaction, and comprising:

means which, under an effect of a partial vacuum, reduce a pressure within the volume of the garbage can and compact waste located therein, wherein said means includes an airtight deformable enclosure in which the waste, optionally in a disposable bag, is collected, said airtight deformable enclosure having at least one side wall composed of an assembly of rigid plates or boards hinged together to form a deformable apron which, under the effect of the partial vacuum acting inside the enclosure, subjects the waste to a compressive load between said side wall forming the deformable apron and another wall opposite said side wall forming the deformable apron, a face of said enclosure being open for the introduction of the waste and being provided with an airtight lid.

2. The garbage can as claimed in claim 1, wherein the deformable enclosure consists of a strong plastic airtight flexible bag or envelope bag which is positioned in a supporting structure or cladding and which forms a separate deformable container in which the waste, optionally in a disposable bag, is collected, said container comprising at least one side wall fitted with said rigid plates or boards that form said deformable apron.

3. The garbage can as claimed in claim 1, wherein the deformable enclosure consists of an airtight flexible bag or envelope bag made by assembling, a number of coated fabric surfaces in the shape of a right-angled parallelepiped, having a small face which is open to allow the waste to be put in, while another small face forms a bottom that is rigid, said envelope bag being attached in an airtight manner to a rigid frame acting as a plane of closure for a door that is used to close the open small face of the envelope bag, and at least a large wall of the envelope bag being made in such a way as to form said deformable apron by being fitted with said hinged plates or boards.

4. The garbage can as claimed in claim 3, wherein the rigid boards or plates are positioned in contiguous pockets provided on the inside face of said wall forming the deformable apron, these pockets being closed by adhesive bonding after said plates or boards have been placed in them.

5. The garbage can as claimed in claim 3, wherein the hinged plates or boards are bonded directly to the envelope bag.

6. The garbage can as claimed in claim 3, wherein the hinged plates or boards are produced as a composite structure including a flexible material overmolded onto a rigid material.

7. The garbage can as claimed in claim 3, wherein the envelope bag has thickened sections or a network of ribs.

8. The garbage can as claimed in claim 1, wherein said another wall also composed of an assembly of rigid plates or boards to form a deformable apron.

9. The garbage can as claimed in claim 1, wherein small sides of said deformable enclosure fold outward when the partial vacuum is applied.

10. The garbage can as claimed in claim 1, wherein a small side forming a bottom of the can comprises at least two telescopic rigid plates.

11. The garbage can as claimed in claim 1, wherein a small side forming a bottom of the can comprises two rigid plates hinged to each other.

12. The garbage can as claimed in claim 1, wherein a small side forming a bottom of the can is a thick, flexible elastomeric material.

13. The garbage can as claimed in claim 1, further comprising means for squashing the waste vertically down and preventing the waste from expanding upward again after the partial vacuum is broken.

14. The garbage can as claimed in claim 13, wherein the waste is squashed vertically down by a ram provided underneath the closing lid (6) of the can, the ram pushing the waste down mechanically as the can is closed.

15. The garbage can as claimed in claim 13, wherein the waste is squashed vertically down by a bellows or piston-type means underneath the closing lid of the can, this means moving vertically to push the waste down, in response to negative pressure when a partial vacuum is created inside the can.

16. The garbage can as claimed in claim 15, wherein pressure is applied inside said bellows or piston-type means to assist in squashing the waste down to the bottom of the deformable enclosure.

17. The garbage can as claimed in claim 13, wherein the waste is squashed vertically down by a flexible compressible part at the top of the deformable enclosure.

18. The garbage can as claimed in claim 13, wherein the waste is squashed vertically down by telescopic boards located at the top of the side walls of the deformable enclosure.

19. The garbage can as claimed in claim 13, wherein the waste is squashed vertically down by hinged boards (23) forming a parallel motion mechanism at the top of the side walls of the deformable enclosure.

20. The garbage can as claimed in claim 13, wherein the waste is squashed vertically down by applying a vibrating movement to the deformable enclosure, this movement being obtainable from a natural vibration of a vacuum pump used to place the can under partial vacuum.

21. The garbage can as claimed in claim 1, further comprising means for preventing the waste expanding upward again after the vacuum is broken.

22. The garbage can as claimed in claim 21, wherein said preventing means makes the deformable enclosure wedge-shaped.

23. The garbage can as claimed in claim 21, wherein said preventing means provides asperities on the inside surface of the deformable enclosure.

24. The garbage can as claimed in claim 23, wherein said asperities are provided on the rigid boards or plates of the deformable aprons.

25. The garbage can as claimed in claim 1, further comprising means for keeping the waste in position after compression by preventing waste from expanding upward again inside the deformable enclosure, the waste keeping means further creating an unoccupied entrance space at a top of the deformable enclosure.

26. The garbage can as claimed in claim 25, wherein said waste keeping means provides, at the top of the deformable enclosure, a moving neck operated by opening a door, which neck may be made in the form of an inflatable bladder that presses against an outer surface of the top of the deformable enclosure.

27. The garbage can as claimed in claim 25, wherein said waste keeping means further comprises a fixed neck made of a flexible material, in the form of flexible boards positioned on the inside of the deformable enclosure, at its top, these boards performing a non-return function.

28. The garbage can as claimed in claim 27, wherein said waste keeping means further comprises a lid having a configuration for promoting the passage of waste through said fixed neck.

* * * * *